United States Patent [19]

Townshend

[11] 4,184,407

[45] Jan. 22, 1980

[54] ACOUSTIC DRUMS

[76] Inventor: Patrick C. Townshend, Flat 2, 94 Ledbury Rd., London W.11, England

[21] Appl. No.: 930,870

[22] Filed: Aug. 4, 1978

[30] Foreign Application Priority Data

Aug. 5, 1977 [GB] United Kingdom ..... 32885/77

[51] Int. Cl.[2] ..... G10D 13/02

[52] U.S. Cl. ..... 84/411 R

[58] Field of Search ..... 84/411 R, 411 A, 411 M, 84/411 P, 412, 413, 415, 420

[56] References Cited

U.S. PATENT DOCUMENTS

| | | | |
|---|---|---|---|
| 2,858,724 | 11/1958 | Troppe | 84/411 R |
| 3,603,194 | 9/1971 | North | 84/411 R |
| 3,621,749 | 11/1971 | Aluisi | 84/411 R |
| 4,102,236 | 7/1978 | North | 84/411 R |
| 4,134,324 | 1/1979 | LeMert | 84/411 R |

*Primary Examiner*—Lawrence R. Franklin

*Attorney, Agent, or Firm*—Fitzpatrick, Cella, Harper & Scinto

[57] ABSTRACT

A musical drum has a hollow elongate body of resin impregnated glass fibre, open at both ends. A membrane is stretched across one end and secured thereto. The said end is circular and the body has a cylindrical portion including the said end and then has a flared portion with a curved central axis. The flared portion terminates in a generally oval opening and includes a hollow ridge. In use of the drum, two notes are produced, one at the center of the open end and the other, an octave lower, in the ridge.

A bass drum incorporating the invention is also described.

6 Claims, 6 Drawing Figures

ACOUSTIC DRUMS

The invention relates to acoustic or musical drums and provides a musical drum comprising a hollow elongate body open at both ends and a membrane stretched across one end of the body and secured in tension thereto in which the body increases in cross-sectional area from one end to the other, the smaller diameter end being circular in cross-section and having the membrane stretched thereacross and the larger diameter end being defined by one or more apertures, the or each aperture having a non-circular periphery of a generally regular shape but including a protuberance at one part of the periphery, the arrangement being such that, when the membrane is struck, a first note is detectable in the central part of the or each aperture and a second note is detectable in the protuberance, the second note being one octave lower than the first note.

The body may be a single integral moulding of fibreglass impregnated with polyester resin and may be cylindrical for a portion of its length adjacent to the end to which the membrane is secured.

Preferably the or each aperture is generally oval and the protuberance is formed at an end of the minor diameter of the oval so that the aperture is symmetrical about said minor diameter.

In one embodiment, the larger diameter end of the body is defined by a single aperture and a central axis of the body curves through an arc for at least a part of its length.

In another embodiment there are two apertures arranged with their minor diameters at right angles so that the protuberances of the two apertures are adjacent one another.

Further features and advantages of the invention will become apparent from the following description, by way of example, of two preferred embodiments of drums according to the invention, the description being read with reference to the accompanying drawings, in which.

Figure 1:
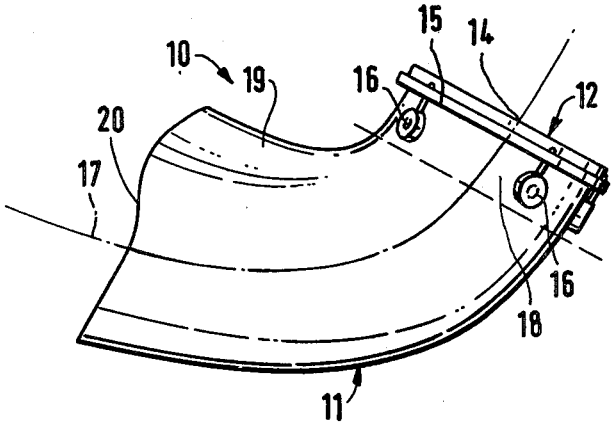
FIG. 1 is a side elevation view of a musical drum according to the invention.
Figure 2:
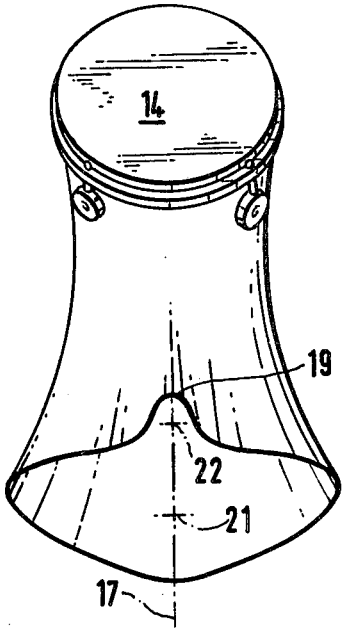
FIG. 2 is a plan view of the drum of FIG. 1.
Figure 3:
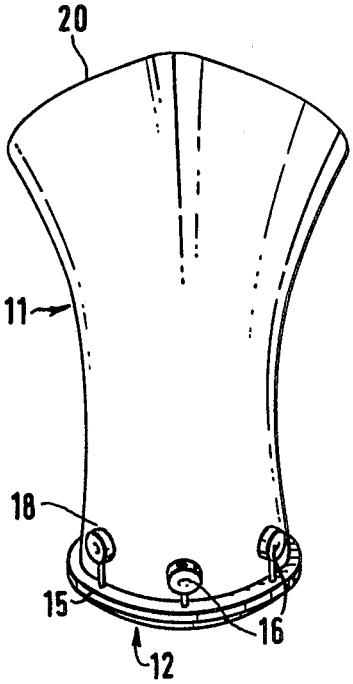
FIG. 3 is an underneath plan view of the drum of FIG. 1.
Figure 4:
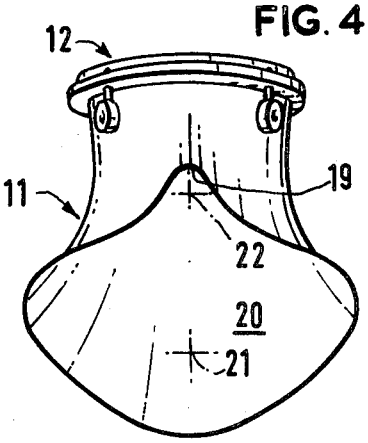
FIG. 4 is a view from the front of the drum of FIG. 1.

Referring first to FIGS. 1 to 4 of the drawings, a musical drum 10 comprises a body 11 and a head portion 12. The head portion 12 is circular and consists of a conventional skin or membrane 14 which is stretched across one end of the body 11 and secured in position in the conventional manner by a hoop 15 and screw-lug devices 16.

The body 11 is a one piece moulding of fibreglass impregnated with polyester resin and has no joints or seams. The body 11 is hollow and open at both ends, the head being fitted to one end. The first section 18 of the body, extending from the end to which the head is secured, is cylindrical for approximately the first fifth of the total length of the drum as measured along its central axis 17. The body shell then flares outwardly and turns upwardly into an oval shape with a raised hollow ridge 19 at the central upper part of the oval. The ridge expands in size as the oval flaring expands outwards to the other open end 20 of the body which is the mouth of the drum.

The central axis 17 of the body 11 is a line which passes through the centres of the circular planes in the cylindrical section 18 of the body and is straight for this portion and then curves in an arc through the intersections of the major and minor diameters of the basic oval planes of the remainder of the body. The ridge 19 is a curved protuberance extending outwardly of the periphery of the oval planes at one end of their minor diameters so that the mouth 20 is symmetrical about its minor diameter.

It is found that the above-described shape produces two notes which are detectable from the mouth 20 of the drum 10 when used in conjunction with public address systems or recording microphones and instruments when the membrane 14 is beaten. One note is detectable at the centre 21 of the basic oval of the mouth of the drum and another note which is an octave lower is detectable from the hollow raised ridge 19 at 22.

The body shape described above may be utilised in different sizes for the following types of drums: toptoms, floor-toms, concert-toms, snare drums, bass drums, conga drums, bongo drums. In order to produce these different drums, the diameter of the head end of the body 11 may be 6", 8", 10", 12", 13", 14", 15", 16", 18", 20", 22", 24" or 26". In one particular example in which the head diameter was 12", the major and minor diameters of the oval section at the mouth end were 17" and 13" respectively and the mouth dimension from the lip of the ridge to the opposite side of the mouth was 15". In the example, the length of the cylindrical portion 18 of the drum body was 7" and the overall length of the body 33".

Figure 5:
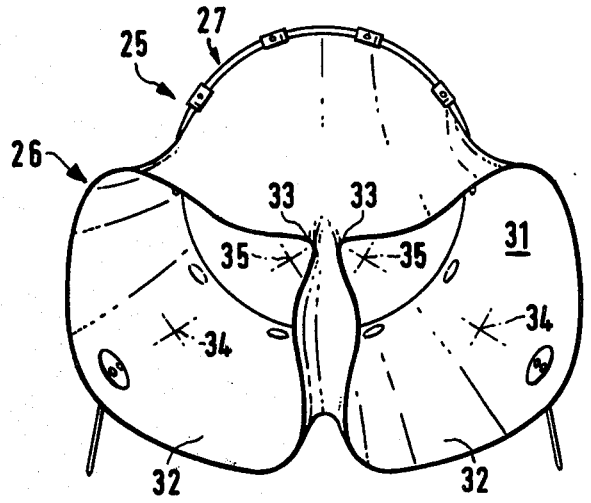
FIG. 5 is a view from the front of a bass drum.
Figure 6:
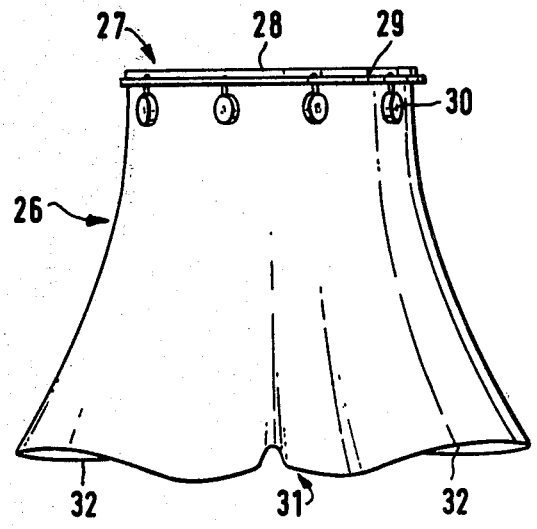
FIG. 6 is a plan view of the bass drum of FIG. 5.

It is found that the body shape described above becomes rather unwieldy when reproduced in the larger head diameters mentioned above and a modified form of body is illustrated in FIGS. 5 and 6 which is particularly suitable for bass drums.

Referring to FIGS. 5 and 6, the bass drum 25 comprises a hollow body 26 open at both ends and a head 27 secured to one end of the body. The head 27 is similar to head 12 and comprises a stretched membrane 28 secured to the body by a hoop 29 and screw-lug devices 30. The end of the body 26 to which the head 27 is secured is cylindrical for approximately one-fifth of the length of the body which then flares outwardly and curves to the other (mouth) end 31 of the body. The mouth 31 of the drum is formed by two apertures 32 each of which has the same peripheral shape as the mouth 20 of drum 10, being basically oval with a ridge 33. The apertures 32 are arranged with their minor diameters at right angles so that the two ridges 33 are adjacent to one another at the upper part of mouth 31.

Two notes are detectable at the mouth 31 when the membrane 28 is beaten, one at the centres 34 of the two apertures 32 and the other in the two ridges 33 at parts 35, which is an octave lower.

I claim:

1. A musical drum comprising a hollow elongate body open at both ends and a membrane stretched across one end of the body and secured in tension thereto in which the body increases in cross-sectional area from one end to the other, the smaller diameter end being circular in cross-section and having the membrane stretched thereacross and the larger diameter end being defined by one or more apertures, the or each aperture having a non-circular periphery of a generally regular shape but including a protuberance at one part of the periphery, the arrangement being such that, when the membrane is struck, a first note is detectable in the central part of the or each aperture and a second note is detectable in the protuberance, the second note being one octave lower than the first note.

2. A drum as claimed in claim 1 in which the body is a single integral moulding of fibreglass impregnated with polyester resin.

3. A drum as claimed in claim 1 in which the body is cylindrical for a portion of its length adjacent to the end to which the membrane is secured.

4. A drum as claimed in claim 1 in which the or each aperture is generally oval and the protuberance is formed at an end of the minor diameter of the oval so that the aperture is symmetrical about said minor diameter.

5. A drum as claimed in claim 4 in which there are two apertures arranged with their minor diameters at right angles so that the protuberances of the two apertures are adjacent one another.

6. A drum as claimed in claim 1 in which the larger diameter end of the body is defined by a single aperture and a central axis of the body curves through an arc for at least a part of its length.

* * * * *